United States Patent [19]

Whiting

[11] Patent Number: 4,971,361

[45] Date of Patent: Nov. 20, 1990

[54] PRESENTATION FOLDER

[76] Inventor: Robert L. Whiting, 292 Castlebar Rd., Rochester, N.Y. 14610

[21] Appl. No.: 451,611

[22] Filed: Dec. 18, 1989

[51] Int. Cl.[5] ..... B42D 1/00

[52] U.S. Cl. ..... 281/2; 281/5; 281/15.1; 283/62

[58] Field of Search ..... 281/2, 5, 15.1, 21.1, 281/29, 35, 51, 45; 283/62, 63.1, 64, 34, 35

[56] References Cited

U.S. PATENT DOCUMENTS

| | | | |
|---|---|---|---|
| 257,117 | 4/1882 | Wentworth | 281/15.1 |
| 938,910 | 11/1909 | Sultzer . | |
| 2,052,623 | 9/1936 | Harby . | |
| 2,061,168 | 11/1936 | Nixon . | |
| 2,475,067 | 7/1949 | Wege . | |
| 2,865,659 | 12/1958 | Zimmermann . | |
| 2,982,322 | 5/1961 | Seitz . | |
| 3,105,495 | 10/1963 | Heyer . | |
| 3,758,022 | 7/1988 | Podosek et al. | 281/15.1 |
| 4,270,773 | 6/1981 | Gaetano | 283/62 |
| 4,548,426 | 10/1985 | Lockhart . | |

FOREIGN PATENT DOCUMENTS

| | | | |
|---|---|---|---|
| 2835217 | 2/1980 | Fed. Rep. of Germany | 281/2 |

*Primary Examiner*—Frank T. Yost
*Assistant Examiner*—Hwei-Siu Payer
*Attorney, Agent, or Firm*—Eugene Stephens & Associates

[57] ABSTRACT

A presentation folder for securing and protecting documents is formed in a single sheet of paper by a series of folds or hinges. In addition to the usual features of front and back covers, the folder includes a reinforcing panel for the back cover and a binding strip for attaching documents to the reinforcing panel. The binding strip includes two parts, namely, a mounting flap to which the documents are attached and a mounting strap which joins the binding strip to the reinforcing panel and conceals the mounting flap.

23 Claims, 4 Drawing Sheets

PRESENTATION FOLDER

FIELD OF INVENTION

The invention relates to presentation folders and, in particular, to report, proposal, and brochure folders for securing and protecting related materials therein.

BACKGROUND

A current trend in business is an increased appreciation of the importance of the appearance of presentation materials (i.e., reports, proposals, and brochures). While it has long been recognized in the fields of advertising and sales that the appearance of such materials may be seen to reflect on the quality of the subject matter contained in those materials, the ever increasing amount of competing information in business has lead other professions to place increased emphasis on the appearance of presentation materials to call special attention to their work. Much of this trend may be linked to the increasing availability of computers for compiling information and for formatting information according to standards previously requiring specialized publishing equipment. In fact, presentation materials including neatly organized text and graphics are now commonplace in most businesses.

However, computer generated materials are usually in the form of individual sheets that must be collected and joined together to form a completed work. It is also known to further improve the appearance of such work by binding the work in a folder. Although it is now possible to print quality text and graphics with widely available computer systems at virtually no additional cost over the time required to format the information, professional appearing folders often add a considerable incremental cost to the work that cannot be justified on a routine basis. The incremental cost of the folder is based not only on the cost of the folder itself but also on the cost of binding materials together in the folder. Alternatively, cheaply made folders or even certain generic types of folders may actually detract from the professional appearance of a work.

For example, it is known to bind loose sheets together in a folder using a clear plastic front sheet, a cardboard back sheet, and a plastic binding clip that fastens the sheets together along their length. Although this binding approach involves only limited expense, the appearance of such folders is nondistinctive and not of a professional quality equal to the quality of the text and graphics that is routinely available. It would also be prohibitively expensive to print on such plastic front covers to enhance their professional appearance.

Another common approach uses a folded paper to form front and back covers of a folder, and a folded binding strip that is stapled to the folder along their common fold line. Loose-leaf materials are secured between the folds of the binding strip by tabs attached to one of the folds which pass through specially spaced holes in both the loose-leaf materials and the other fold of the binding strip. The staples are clearly visible and unattractive on the outside of the folder, and the tabs are similarly unattractive inside the folder. Also, an additional step of punching specially spaced holes in the loose-leaf materials is required which takes additional time for assembling the folder.

Accordingly, it may now be appreciated that a need exists for an inexpensive, yet versatile and professionally appearing folder for binding together loose-leaf presentation materials. More particularly, the folder (a) should be of sufficient quality to enhance the appearance of materials produced by computerized printing techniques, (b) should readily admit of customizing features such as professional printing on the face of the folder, and (c) should be sufficiently inexpensive to make and use on a routine basis.

SUMMARY OF THE INVENTION

The present invention overcomes the above-mentioned problems of prior presentation folders by providing a novel folder having a professional appearance that may be made and used economically. The novel folder is constructed from a single sheet of paper having a series of folds defining three main panels and a two-part document mounting strip. The folder may be formed from a simple rectangular shape or a shape which may be nested with other folders to form a simple rectangular shape. Most importantly, the shape of the folder or nesting of folders may be formed in a continuous roll or stack of paper without significant waste.

The above-mentioned folds in the single sheet function as hinges for changing the angular orientation of the panels and binding strip. A first hinge is formed in the single sheet between two of the panels defining front and back covers of the folder. A second hinge is formed between the back cover panel and the third panel defining the third panel as a reinforcing panel that may be folded against the interior surface of the back cover panel. A third hinge is formed between the reinforcing panel and the binding strip. Lastly, a fourth hinge, oriented substantially parallel to the third hinge, is formed in the binding strip thereby separating the binding strip into two parts. One part of the binding strip functions as a mounting flap to which looseleaf presentation materials may be attached, for example, by staples. The other part functions as a strap for attaching the mounting flap to the reinforcing panel and for concealing the attachment means to the mounting flap when the two parts of the binding strip are folded together.

A number of more specific versions of the novel presentation folder are also contemplated in the present invention. For example, it is contemplated that all four hinges may be arranged substantially parallel to one another. According to that version, the loose-leaf materials are attached to the mounting flap along their length and the first and third hinges are substantially aligned when the reinforcing panel is folded against the back cover panel. An adhesive strip may also be mounted near the first hinge of the back cover panel for securing the reinforcing panel to the back cover panel. Preferably, the adhesive strip attaches the reinforcing panel either along its common edge with the binding strip or along its edge opposite to the second hinge. Of course, when the second and third hinges are parallel to one another, these two criteria for locating the adhesive strip may be met by the same location of the adhesive strip.

Alternatively, it is contemplated that only three of the four hinges remain parallel and the remaining hinge is oriented substantially perpendicular to the rest. In one variation on this arrangement, the second hinge between the back cover and reinforcing panels may be arranged perpendicular to the other hinges. However, when the reinforcing panel is folded against the back panel, the third hinge between the reinforcing panel and binding strip remains, as in the above-described folder, substantially aligned with the first hinge between the front and back cover panels. In this way, the loose-leaf materials also remain attached to the mounting flap along their length.

Another alternative folder where only three hinges remain parallel provides for the first hinge to be substantially perpendicular to the other hinges. This arrangement is considered to be particularly suitable for mounting legalsize paper in the customary location along the top edge of the paper.

It is also contemplated that a pocket may be formed in the reinforcing panel for holding additional sheet materials between the reinforcing panel and the back cover panel. An additional adhesive strip may be located along either the bottom or side edge of the back cover that is not already hinged to the reinforcing panel to further enclose the pocket. An additional hinge located along an edge of the back cover panel may be used to define a tab having an adhesive strip that may be secured to the reinforcing panel for the same purpose.

It is yet further contemplated that a window may be formed through the front cover of the folder to expose a portion of the title or first page of the materials bound within the folder. However, even more importantly, it is contemplated that at least the front cover, and preferably both the front and back covers, include customized printing for creating a unique appearance to the folder. The customized printing enables businesses, firms, and even particular operating units within businesses to be identified on the covers of the folders in ways often previously reserved for expensive advertising materials. However, the simple, single sheet construction of the novel presentation folder can be made so inexpensively in a form which readily admits of professional printing that the present invention provides a cost effective but suitable form for binding the increasing quantity of text and graphics works regularly produced in business.

DRAWINGS

DETAILED DESCRIPTION

Figure 1:
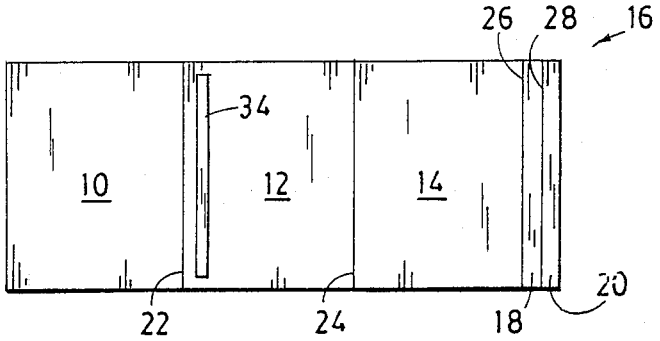
FIG. 1 is a plan view of the novel presentation folder showing the various parts of the folder formed in a single sheet.

A single sheet from which the presentation folder of the present invention may be constructed is shown in FIG. 1. Four parallel folds or hinges are impressed in the sheet defining three main panels and a two-part binding strip. In particular, a first hinge 22 is located between a front cover panel 10 and a back cover panel 12. A second hinge 24 is located between back cover panel 12 and a reinforcing panel 14. A binding strip 16 is joined to reinforcing panel 14 by a third hinge 26; and the binding strip is divided into two parts, namely, a mounting strap 18 and a mounting flap 20 by a fourth hinge 28.

Although all three main panels may be made substantially equal in size, it is important that the width of reinforcing panel 14, defined by the distance between the second and third hinges, does not exceed the width of back cover panel 12, defined by the distance between the first and second hinges. This limitation is important so that reinforcing panel 14 may be folded against back panel 12 about second hinge 24 without obstructing movement between the front and back cover panels about first hinge 22.

Similarly, it is important that the width of mounting flap 20 does not exceed the width of mounting strap 18. This limitation enables mounting flap 20 to be folded against mounting strap 18 about fourth hinge 28 without obstructing movement of the mounting strap about third hinge 26. The further significance of both of the above-mentioned width limitations will be apparent with reference to other drawing figures.

Figure 2:
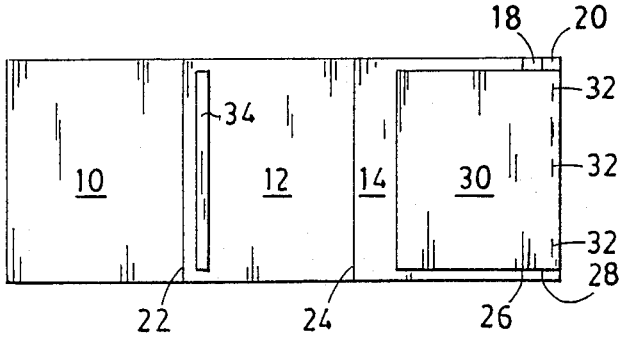
FIG. 2 is a plan view of the same folder showing the attachment of loose-leaf pages to the folder.

Loose-leaf sheets 30 are shown in FIG. 2 stapled in position to mounting flap 20. The view of FIG. 2 reveals an inside surface of the single sheet from which the presentation folder is constructed, and a back surface of one of the loose-leaf sheets that are to be secured within the folder. Although staples 32 are shown attaching the looseleaf sheets to the mounting flap, it may be appreciated that other paper fastening means could also be used. It should also be noted that since the loose-leaf sheets overlay the reinforcing panel, the sheets may be readily aligned with an outer edge of mounting flap 20 for conveniently locating and fastening the sheets to the flap.

Figure 3:
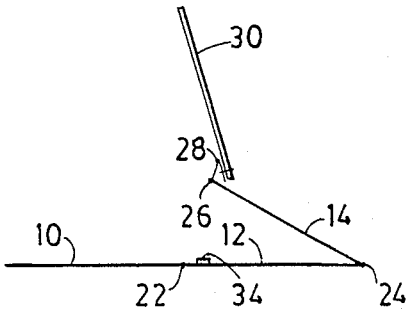
FIG. 3 is an edge view of the bottom of the same folder showing partial folds with which the folder is constructed.

FIG. 3 is a view of the bottom edge of the folder showing interim positions of the reinforcing panel and binder strip being folded about the second, third, and fourth hinges for positioning the loose-leaf sheets within the folder. Reinforcing panel 14 is folded counterclockwise about second hinge 24 until it is overlaid against the inside surface of back cover 12. An adhesive strip 34 (shown better in FIGS. 1 and 2) may be used to secure the reinforcing panel to the back cover. In the illustrated embodiment, the adhesive strip is located on the inside surface of the back cover for joining the reinforcing panel to the back cover along the length of the third hinge.

Mounting strap 18 and mounting flap 20 of binder strip 16 are both folded clockwise for positioning the back surface of the loose-leaf sheets against reinforcing panel 14. However, it is important that mounting flap 20 is folded against mounting strap 18 in advance of completing a fold about third hinge 26 for locking the mounting flap and looseleaf sheets between mounting strap 18 and reinforcing panel 14.

Figure 4:
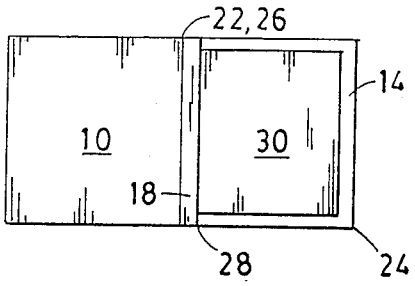
FIG. 4 is a plan view of the same folder opened to the first of the loose-leaf sheets.

A view of the presentation folder described in the preceding figures with loose-leaf sheets 30 secured within the folder is shown in FIG. 4. This is the view that is apparent when the folder is opened to reveal the first of the loose-leaf sheets. It is important to note that in addition to joining the binder strip to the reinforcing panel, mounting strap 18 also conceals the fastening means by which the loose-leaf sheets are attached to the mounting flap. This feature gives a very professional looking appearance to the inside of the folder.

Figure 5:
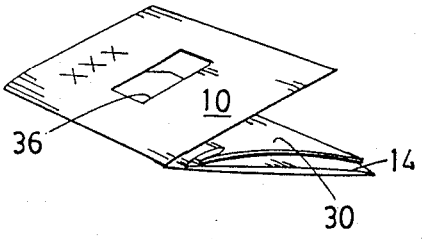
FIG. 5 is a perspective view of the same folder showing exemplary printing on the front cover.

A perspective view showing the outside of front cover 10 and portions of the folded panels and binder strip inside the folder is provided in FIG. 5. Although the actual folds in the panels and binder strip are intended to be more complete, the view shows important directions of the folds discussed above. The front cover is shown with exemplary customized printing that may be used to give a unique and even more professional appearance to the folder. For example, the customized printing may be used to identify the company, firm, or group responsible of the contents of the presentation folder, or may be used to provide generic graphic designs or types of coding that distinguish the presentation folder. Since the front and back covers are formed from the same surface of a single sheet, the printing may be economically applied to both the front and back covers. If desired, it is also possible to form a window 36 in the front cover to reveal a portion of the first or title page of the loose-leaf sheets.

Figure 6:
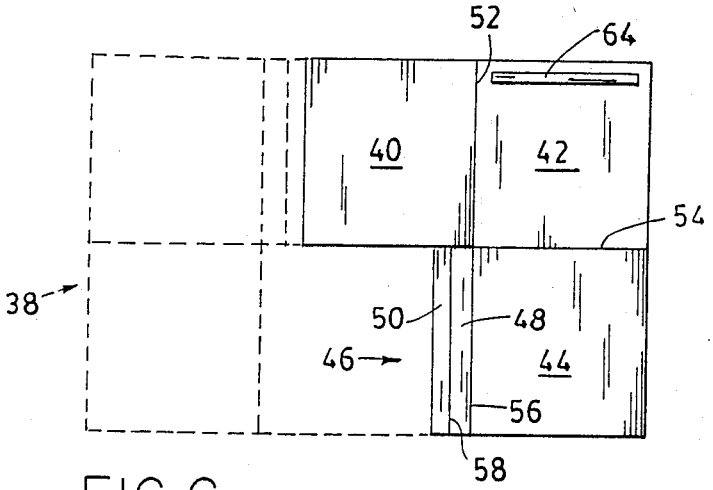
FIG. 6 is a plan view of an alternatively constructed folder showing in dashed line an identical folder nested with the alternative folder for forming a rectangular outline.
Figure 7:
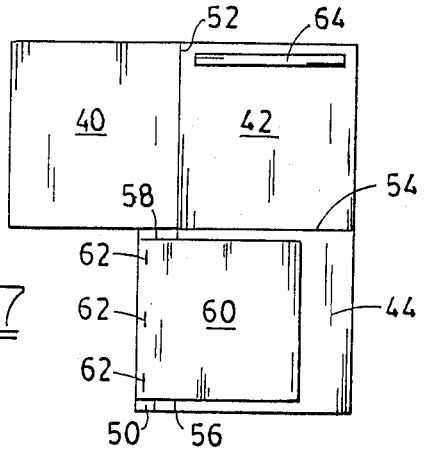
FIG. 7 is a plan view of the alternative folder showing the attachment of loose-leaf sheets.

An alternatively constructed presentation folder is illustrated by FIGS. 6 and 7. The alternative folder includes the same basic elements including four hinges defining three main panels and a two-part binding strip that comprise the folder shown in the preceding figures, but the panels and binding strip of the alternative folder are configured differently with respect to each other. For example, only three of the four hinges of the alternative folder are oriented parallel to each other and the remaining hinge is oriented perpendicular to the rest.

With particular reference to FIG. 6, it can be seen that the three main panels 40, 42, and 44, and binding strip 46 form an "L" shape in a single sheet. However, an identical folder 38 shown in phantom line may be nested together with the alternative folder to form a simple rectangular outline. This feature enables the folders to be formed from a single roll or stack of sheets with little or no waste.

The alternative folder includes details of a first hinge 52 located between front cover panel 40 and back cover panel 42. A second hinge 54 is oriented perpendicular to the first hinge between back cover panel 42 and reinforcing panel 44. A third hinge 56 is substantially aligned with the first hinge and joins binding strip 46 to reinforcing panel 44. A fourth hinge 58 is oriented parallel to the third hinge and separates the binding strip into mounting strap 48 and mounting flap 50.

FIG. 7 shows loose-leaf sheets 60 attached to mounting flap 50 with staples 62. The view is of the inside surface of the single sheet, and staples 62 are inserted through the back of loose-leaf sheets 60. It should also be noted that the loose-leaf sheets are inverted so that the top of the sheets faces downward in FIG. 7. The alternative folder may be folded together in much the same manner as the first illustrated folder so that loose-leaf sheets 60 are positioned within the folder similar to loose-leaf sheets 30 of FIG. 4. An adhesive strip 64 may also be used to secure reinforcing panel 44 to the inside surface of back cover panel 42.

Figure 8:
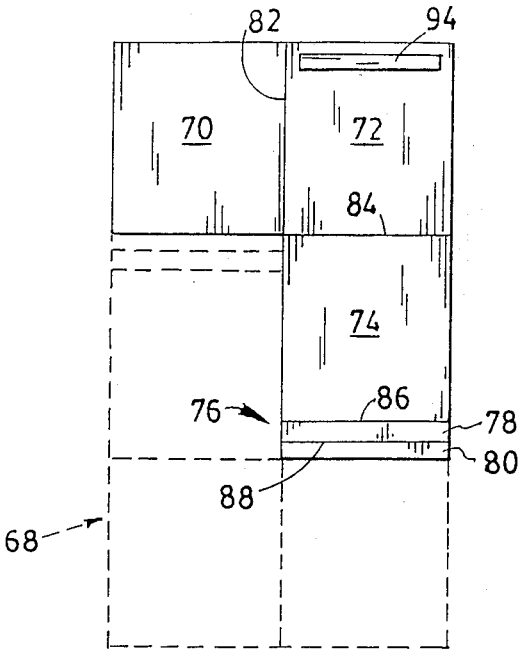
FIG. 8 is a plan view of a second alternative folder and a dashed outline of an identical folder for completing a rectangular shape in a single sheet of paper.
Figure 9:
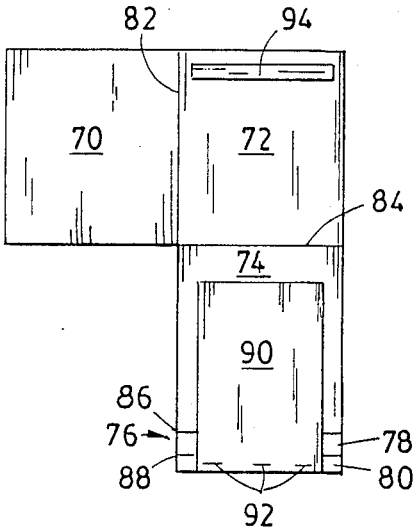
FIG. 9 is another plan view of the second alternative folder showing the attachment of legal-size paper to the folder.
Figure 10:
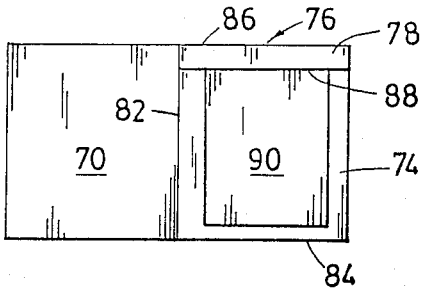
FIG. 10 is another plan view of the second alternative folder opened to expose legal-size paper attached to the top of the folder.

Another alternatively configured presentation folder is illustrated in FIGS. 8 through 10. This version is believed to be particularly useful for securing legal-size sheets within the folder. The legal-size version is also "L-shaped" and may be nested with an identical folder 68 (see FIG. 8) to form a simple rectangular outline.

First and second hinges 82 and 84 define front cover panel 70, back cover panel 72, and reinforcing panel 74 in a manner similar to the first and second hinges of the last-described alternative folder. However, the remaining two hinges, namely third hinge 86 and fourth hinge 88, are oriented parallel to second hinge 84. Thus, in both of the illustrated "L-shaped" folders, three of four hinges are oriented parallel to each other and the remaining hinge is oriented perpendicular to the rest. Similar to both of the previously illustrated folders, third hinge 86 joins binding strip 76 to the reinforcing panel; and fourth hinge 88 separates the binding strip into its characteristic parts, namely, mounting strap 78 and mounting flap 80. Also, an adhesive mounting strip 94 may be used to secure the reinforcing panel to the back cover panel.

FIG. 9 illustrates the orientation at which legal-size sheets 90 are attached the mounting flap. The back face of the sheets is visible in the view shown, and the top edges of the legal-size sheets are attached to the mounting flap by staples 92. Similar to both of the preceding versions of the presentation folder, the legal sheet 90 overlay the reinforcing panel so that one edge of the sheets may be conveniently aligned with and fastened to the mounting flap.

The legal version is shown with the legal-size sheets 90 secured within an open folder in FIG. 10. In contrast to the preceding versions, the mounting strap is located along the top edge of the folder. Accordingly, it is important that the widths of both reinforcing panel 74 and binder strip 76 are no greater than the width of back cover 72 so that the front and back covers may be closed together about first hinge 82.

Figure 11:
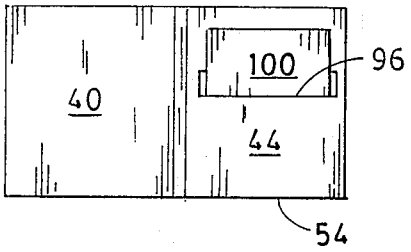
FIG. 11 is an open view of the folder shown in FIGS. 8 and 9 with the loose-leaf sheets removed to expose a pocket for holding additional loose-leaf sheets.
Figure 12:
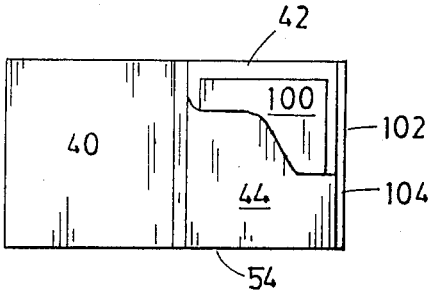
FIG. 12 is a view similar to FIG. 11 showing an alternative way of holding the additional loose-leaf sheets.

FIGS. 11 and 12 show variations of the folder illustrated in FIGS. 6 and 7 for using space between reinforcing panel 44 and back cover panel 42 to hold additional loose-leaf sheets. Such additional sheets may be used to supplement the main body of a report or proposal that is attached to the binding strip. In the variation illustrated in FIG. 11, a window 96 is formed through the reinforcing panel defining a pocket between the reinforcing panel and back cover panel. Loose-leaf sheets 100 are held in the pocket by the sides of window 96 and second hinge 54.

In FIG. 12, a pocket is formed between the reinforcing panel and the back cover panel by partly cutting away a top portion of the reinforcing panel. Of course, since the top portion of the reinforcing panel is cut away, adhesive strip 64 should be moved to a new location between the reinforcing panel and back cover or removed altogether. A tab 104 is used to secure the exposed edge of the pocket. The tab is folded about a fifth hinge 102 against the reinforcing panel and secured in place by an adhesive strip (not shown). Tab 104 also extends the full length of the back cover to reinforce the entire outer edge of the back cover.

Although pockets have been shown only with respect to the presentation folder previously illustrated in FIGS. 6 and 7, it may be appreciated that similar pockets may be formed between the reinforcing panel and back cover panel of either of the two other presentation folders illustrated in FIGS. 1 through 5 and 8 through 10. For example, a pocket may be formed in the folder of FIGS. 8 through 10 by partly cutting away a portion of reinforcing panel 74 midway along the length of first hinge 82. The exposed edge of the pocket may be sealed by an adhesive strip located between the reinforcing panel and back cover or by securing a tab portion of the back cover to the reinforcing panel.

It may also be appreciated that the single sheet from which the folder is constructed may be made from paper stock of various colors, sizes, and textures. Preferably, at least one side of the sheet includes a glossy finish or other surface to which professional printing may be easily applied. Also, although the paper should be of sturdy construction, it may be appreciated that the reinforcing panel significantly increases the strength of the folder and permits a thinner gauge of paper to be used with good results.

Finally, those of skill in the art will appreciate that although only three main examples of the novel presentation folder have been described in detail, other examples will be apparent within the teaching of the present invention and the scope set forth in the appended claims.

I claim:

1. A presentation folder for securing and protecting loose-leaf sheets therein comprising:

three main panels and a two-part binding strip formed in a single sheet of folder material;

a first hinge formed in said folder material between a first and second of said main panels defining a front cover and a back cover, respectively;

a second hinge formed in said folder material between said back cover and a third of said main panels defining said third main panel as a reinforcing panel;

a third hinge formed in said folder material joining said binding strip to said reinforcing panel;

a fourth hinge formed in said folder material oriented substantial parallel to said third hinge defining in said binding strip a mounting flap for attaching the loose-leaf sheets to the folder and a mounting strap said third and fourth hinges for concealing said mounting flap; and means for securing said reinforcing panel to an interior surface of said back cover.

2. The presentation folder of claim 1 wherein said third and fourth hinges defining said mounting strap therebetween are spaced apart at a distance not than a distance between said fourth hinge and one edge of said reinforcing panel defining said mounting flap therebetween.

3. The presentation folder of c 2 wherein at least three of said four hinges are oriented substantially parallel to one another.

4. The presentation folder of claim 3 wherein said mounting flap includes an outer edge in common with said single sheet of folder material and said binding strip is oriented with respect to said reinforcing panel so that one edge of the loose-leaf sheets may be aligned with said edge of the mounting flap for attaching the loose-leaf sheets to said folder.

5. The presentation folder of claim 4 wherein all four of said hinges are oriented substantially parallel to one another.

6. The presentation folder of claim 5 wherein said first and second hinges are spaced apart at a distance not less than a distance at which said second and third hinges are spaced apart.

7. The presentation folder of claim 6 wherein said first and third hinges are substantially aligned by attaching said reinforcing panel to said interior surface of the back cover.

8. The presentation folder of claim 7 wherein said reinforcing panel is attached to said back cover in the vicinity of said first hinge.

9. The presentation folder of claim 8 wherein a window is formed in said front cover for viewing a portion of a top page of the loose-leaf sheets mounted in said folder.

10. The presentation folder of claim 8 wherein a portion of said reinforcing panel is removed to form a pocket between said reinforcing panel and said back cover for holding additional loose-leaf sheets.

11. The presentation folder of claim 10 wherein said reinforcing panel is also attached to said back cover along a bottom edge of the back cover to enclose said pocket formed between the reinforcing panel and back cover.

12. The presentation folder of claim 11 wherein a fifth hinge is formed in said folder material along said bottom edge of the back cover defining a tab that may be folded against and secured to said back cover for enclosing said pocket.

13. The presentation folder of claim 4 wherein said second hinge is oriented substantially perpendicular to said first hinge.

14. The presentation folder of claim 13 wherein said folder forms a substantially L-shaped outline in said single sheet that may be nested together with another identical folder to form a collective rectangular outline in said single sheet.

15. The presentation folder of claim 13 wherein said first and third hinges are substantially aligned in said sheet of folder material.

16. The presentation folder of claim 15 wherein said second hinge is also oriented substantially perpendicular to said third and fourth hinges.

17. The presentation folder of claim 15 wherein a length of the loose-leaf sheets is aligned with said edge of the mounting flap.

18. The presentation folder of claim 13 wherein said second and third hinges are oriented substantially parallel to each other.

19. The presentation folder of claim 18 wherein a width of said loose-leaf sheets is aligned with said edge of the mounting flap.

20. The presentation folder of claim 15 wherein a window is formed in said front cover for viewing a portion of a top page of the loose-leaf sheets mounted in said folder.

21. The presentation folder of claim 15 wherein a portion of said reinforcing panel is removed to form a pocket between said reinforcing panel and said back cover for holding additional loose-leaf sheets.

22. The presentation folder of claim 21 wherein said reinforcing panel is also attached to said back cover along a side edge of the back cover to enclose said pocket formed between the reinforcing panel and back cover.

23. The presentation folder of claim 22 wherein a fifth hinge is formed in said folder material along said side edge of the back cover defining a tab that may be folded against and secured to said back cover for enclosing said pocket.

* * * * *